US009022798B2

(12) United States Patent
Kida et al.

(10) Patent No.: US 9,022,798 B2
(45) Date of Patent: May 5, 2015

(54) CONNECTOR

(71) Applicant: Yazaki Corporation, Minato-ku, Tokyo (JP)

(72) Inventors: Kousuke Kida, Shizuoka (JP); Takuya Hasegawa, Shizuoka (JP); Nozomi Tsurukubo, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 13/969,657

(22) Filed: Aug. 19, 2013

(65) Prior Publication Data

US 2014/0017927 A1 Jan. 16, 2014

Related U.S. Application Data

(63) Continuation of application No. PCT/JP2011/079306, filed on Dec. 19, 2011.

(30) Foreign Application Priority Data

Feb. 21, 2011 (JP) ..... 2011-034644

(51) Int. Cl.
*H01R 13/627* (2006.01)
*H01R 13/506* (2006.01)
*H01R 13/58* (2006.01)

(52) U.S. Cl.
CPC ..... *H01R 13/6275* (2013.01); *H01R 13/506* (2013.01); *H01R 13/6272* (2013.01); *H01R 13/5829* (2013.01)

(58) Field of Classification Search
CPC ..... H01R 13/6275; H01R 13/6272
USPC ..... 439/358, 357, 352–356, 488, 140
See application file for complete search history.

(56) References Cited

U.S. PATENT DOCUMENTS 5,947,763 A * 9/1999 Alaksin ..... 439/489
7,326,074 B1 * 2/2008 Lim et al. ..... 439/352

(Continued)

FOREIGN PATENT DOCUMENTS

CN 2052154 1/1990
JP H7-57818 A 3/1995

(Continued)

OTHER PUBLICATIONS

Korean Office action letter issued on Nov. 18, 2014 in the counterpart Korean patent application.
Office action letter issued on Feb. 11, 2015, in the counterpart Chinese patent application.
Office action letter issued on Dec. 16, 2014, in the counterpart Australian patent application.

*Primary Examiner* — Neil Abrams
*Assistant Examiner* — Phuong T Nguyen
(74) *Attorney, Agent, or Firm* — Marvin A. Motsenbocker; Mots Law, PLLC

(57) ABSTRACT

A connector comprises: a connector housing that has a lock arm that locks a mated corresponding housing in a corresponding housing mating chamber, an arm operation part that can displace the lock arm to a position that releases the lock by an operation, a wire extraction part that is positioned in the release operation direction of the arm operation part and guides wires that are guided to the outside, a cover attachment part provided on the wire extraction part; and a wire cover that has a housing attachment part that is inserted into the peripheral side of the wire extraction part of the connector housing and mated to the cover attachment part and an arm excessive displacement prevention part that restricts excessive displacement of the lock arm.

2 Claims, 8 Drawing Sheets

(56) References Cited

U.S. PATENT DOCUMENTS

| | | | | |
|---|---|---|---|---|
| 7,455,527 | B2 * | 11/2008 | Nordin et al. | 439/49 |
| 8,277,243 | B1 * | 10/2012 | Hernandez et al. | 439/352 |
| 8,568,159 | B2 * | 10/2013 | Noda et al. | 439/470 |
| 8,784,127 | B2 * | 7/2014 | Bashkin et al. | 439/372 |
| 2002/0025713 | A1 | 2/2002 | Tabata | |
| 2008/0020613 | A1 | 1/2008 | Matsuura et al. | |
| 2013/0078842 | A1 * | 3/2013 | Lee et al. | 439/352 |

FOREIGN PATENT DOCUMENTS

| | | | |
|---|---|---|---|
| JP | H9-139249 | A | 5/1997 |
| JP | 2000-82538 | A | 3/2000 |
| JP | 2002-75526 | A | 3/2002 |
| JP | 2008-27691 | A | 2/2008 |

* cited by examiner

CONNECTOR

CROSS REFERENCE TO RELATED APPLICATIONS

This application is a continuation application of International Application No. PCT/JP2011/079306, filed on Dec. 19, 2011, which claims priority to Japanese Patent Application No. 2011-034644, filed on Feb. 21, 2011, the entire contents of which are incorporated by references herein.

BACKGROUND OF THE INVENTION

1. Field of the Invention

The present invention relates to a connector with a connector housing to which a wire cover is attached.

2. Description of the Related Art

For example, some connectors to be used for automobile wiring harnesses each include a lock arm for keeping the connector and a corresponding connector mated to each other (see JP 7-57818 A and JP 2008-27691 A). A conventional example of the connector of this kind is shown in FIGS. 1 to 3B.

In FIGS. 1 to 3B, a connector hF3ousing 51 of a connector includes: a corresponding housing mating chamber 52 open on the housing front side; a lock arm 53 configured to lock a corresponding housing (not illustrated) which is mated to the corresponding housing mating chamber 52; a wire extraction part 54 configured to guide and extract wires (not illustrated) from the housing rear to the outside; and an arm excessive displacement prevention part 55 provided projectingly upward from the wire extraction part 54.

Terminal housing parts 56 configured to house multiple terminals (not illustrated) are projectingly provided in the corresponding housing mating chamber 52.

The lock arm 53 includes: a lock part 53*a* positioned inside the corresponding housing mating chamber 52; and an arm operation part 53*b* positioned on the housing rear side. While a corresponding connector housing (not illustrated) is not inserted in the corresponding housing mating chamber 52, the lock arm 53 is situated in a lock position shown in FIG. 3A. As shown in FIG. 3A, the lock part 53*a* has an inclined surface (tapered surface) which faces the terminal housing parts 56. The inclined surface inclines in the insertion direction of the corresponding connector housing in such a way as to become closer to the terminal housing parts 56. An opening part 51*a* is formed in the connector housing 51 on the upper surface side of the arm operation part 53*b*. Workers can press down the arm operation part 53*b* by use of this opening part 51*a*. By pressing down the arm operation part 53*b*, the lock arm 53 can be displaced from the lock position (the position shown in FIG. 3A) to the lock release position (the position shown in FIG. 3B) by elastic deformation.

For connector mating with the foregoing configuration, first of all, the corresponding connector housing (not illustrated) is inserted into the corresponding housing mating chamber 52. During the insertion, a front end portion of the corresponding connector housing comes into contact with the inclined surface of the lock part 53*a*, and the lock part 53*a* is subsequently pressed up toward a side surface of the corresponding housing mating chamber 52 in response to the insertion of the corresponding connector housing. When the corresponding connector housing is inserted up to the mating completion position, a locked part (not illustrated) of the corresponding connector housing reaches a position corresponding to the lock part 53*a*. Once the locked part reaches the position, the lock arm 53 returns to the lock position, and the lock part 53*a* is locked to the locked part (not illustrated) of the corresponding connector housing. Thereby, the two connector housings are locked together in the mated state.

For the release of the connector mating, the lock arm 53 is moved to the lock release position by pressing down the arm operation part 53*b*, and the corresponding connector housing (not illustrated) is pulled out of the corresponding housing mating chamber 52.

An advantage of the above-described connector housing 51 is that the connector housing 51 is capable of securely holding the connector mating since the connector housing 51 includes the lock arm 53. Another advantage of the connector housing 51 is that the arm excessive displacement prevention part 55 prevents the lock arm 53 from being excessively displaced.

SUMMARY OF THE INVENTION

Meanwhile, in some cases, a wire cover is attached to the connector housing 51 for the purpose of protecting the wires which are extracted to the outside from the wire extraction part 54.

In this respect, if the structure is that, as shown in FIG. 4, a wire cover 60 is attached to the connector housing 51 by being butted up against a position in the rear of the connector housing 51, the protrusion dimension L2 that the wire cover 60 protrudes from the rear of the connector housing 51 is large. When no space is available behind the rear of the connector housing 51, the wire cover 60 cannot be attached to the connector housing 51.

An idea for making the protrusion dimension L2 of the wire cover 60 shorter is to use an attachment structure in which, as shown in FIG. 5, a portion of the wire cover 60 is inserted into a rear-side portion of the connector housing 51. Since, however, the arm excessive displacement prevention part 55 is provided on the housing rear side of the connector housing 51, the wire cover 60 cannot be attached to the connector housing 51.

Against this background, the present invention has been made for the purpose of solving the foregoing problem. An object of the present invention is to provide a connector which makes it possible to make the protrusion dimension of the wire cover smaller, and concurrently to prevent excessive displacement of the lock arm.

An aspect of the present invention is a connector comprising: a connector housing including a lock arm configured to lock a corresponding housing which is mated to a corresponding housing mating chamber, an arm operation part capable of displacing the lock arm to a lock release position by an operation, a wire extraction part positioned in a release operation direction of the arm operation part, and configured to guide wires to be guided to an outside, and a cover attachment part provided to the wire extraction part; and a wire cover including a housing attachment part to be inserted into a peripheral side of the wire extraction part of the connector housing, and to be mated to the cover attachment part, and an arm excessive displacement prevention part configured to restrict excessive displacement of the lock arm; wherein the housing attachment part includes a lock groove part in an inner surface thereof, the cover attachment part includes a lock wall part projectingly provided in a circumferential direction thereof, and the lock wall part is inserted into the lock groove part so that the housing attachment part is mated to the cover attachment part.

The arm excessive displacement prevention part may be formed from a portion of the housing attachment part.

In the present invention, since the wire cover is attached to the connector housing by inserting the housing attachment part of the wire cover into the connector housing, the protrusion dimension that the wire cover protrudes from the connector housing becomes smaller. In addition, since the arm excessive displacement prevention part is provided to the wire cover, the excessive displacement of the lock arm can be prevented. Accordingly, the protrusion dimension of the wire cover can be made smaller, and the excessive displacement of the lock arm can be prevented.

BRIEF DESCRIPTION OF THE DRAWINGS

FIGS. 3A and 3B show the conventional example, in which FIG. 3A is a cross-sectional view of a connector in which a lock arm is situated in a lock position; and FIG. 3B is a cross-sectional view of the connector in which the lock arm is situated in a lock release position.

FIGS. 10A and 10B show the embodiment of the present invention, in which FIG. 10A is a cross-sectional view of the connector in which a lock arm is situated in a lock position; and FIG. 10B is a cross-sectional view of the connector in which the lock arm is situated in a lock release position.

DESCRIPTION OF THE PREFERRED EMBODIMENTS

Descriptions will be hereinbelow provided for an embodiment of the present invention on the basis of the drawings.

Figure 1:
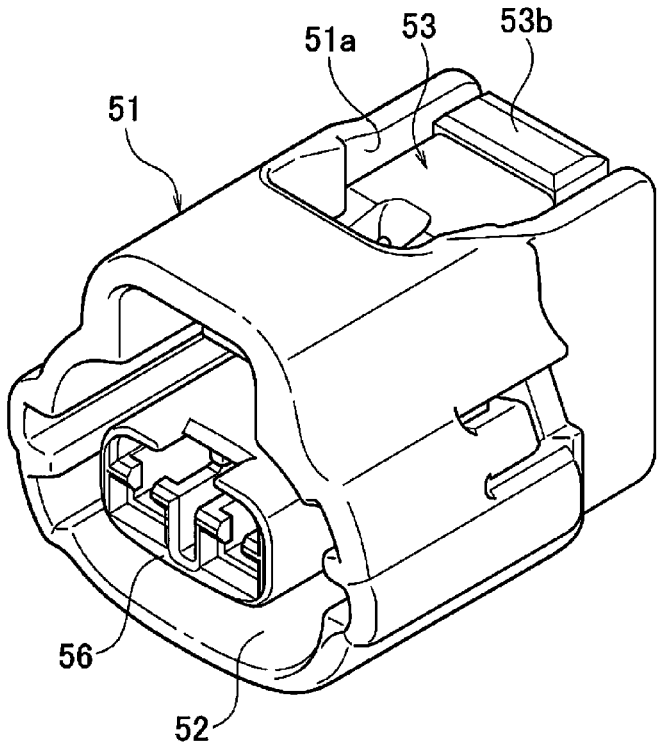
FIG. 1 shows a conventional example, and is a perspective view of a connector housing which is viewed from the housing front.
Figure 2:
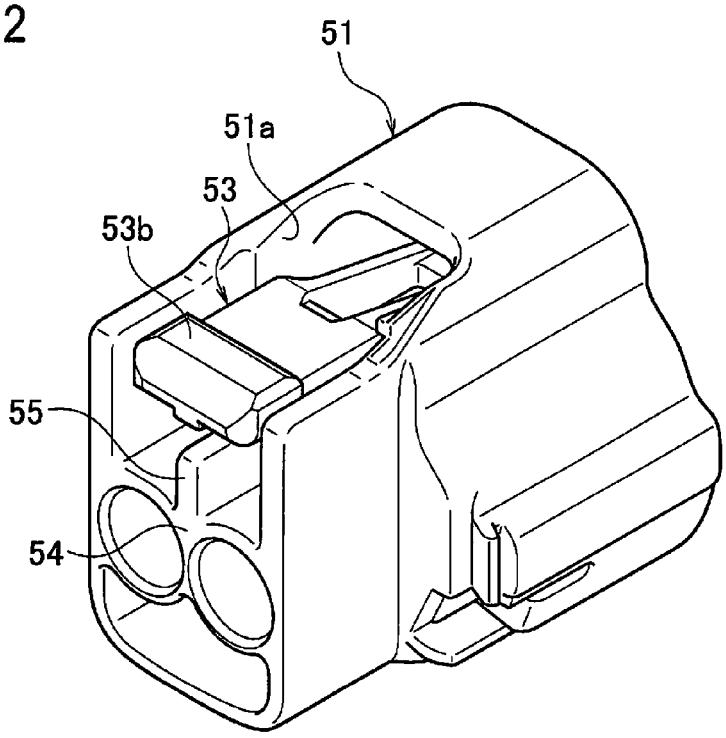
FIG. 2 shows the conventional example, and is a perspective view of the connector housing which is viewed from the housing rear.
Figure 3A:
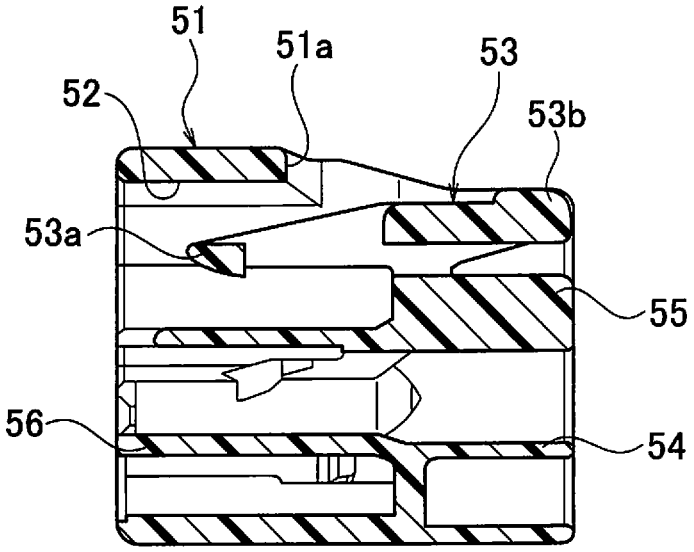
Figure 3B:
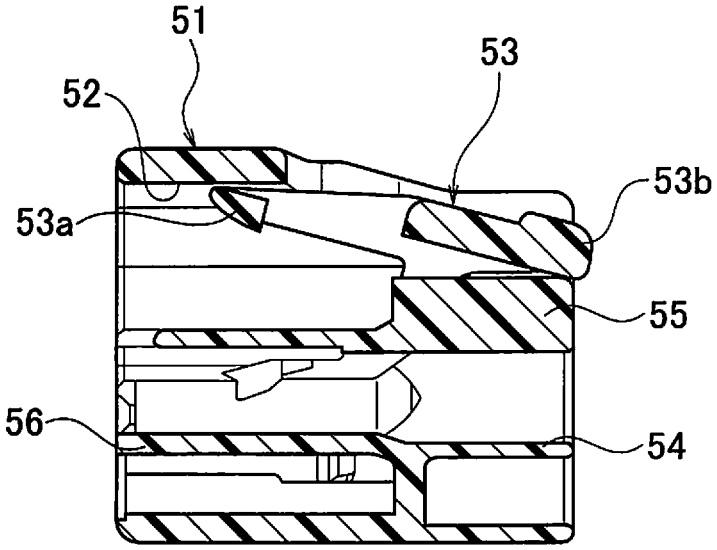
Figure 4:
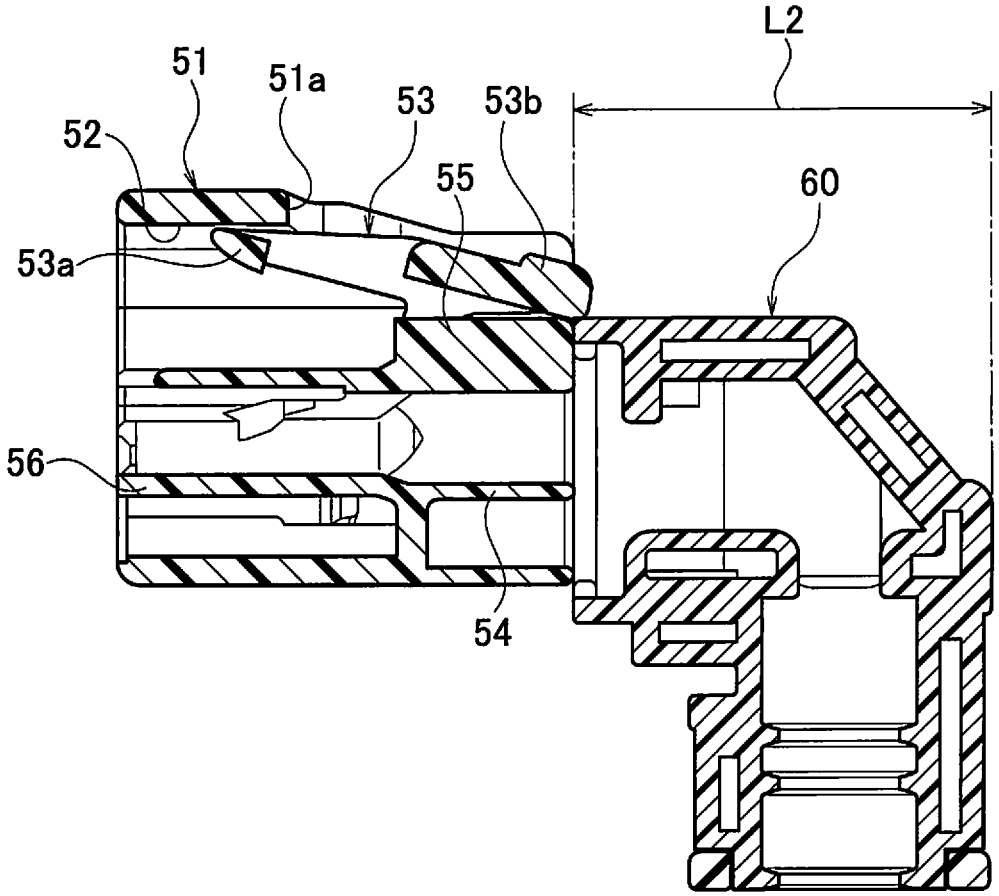
FIG. 4 is a cross-sectional view showing a state in which a wire cover is attached to the connector housing of the conventional example by being butted up against a position in the rear of the connector housing.
Figure 5:
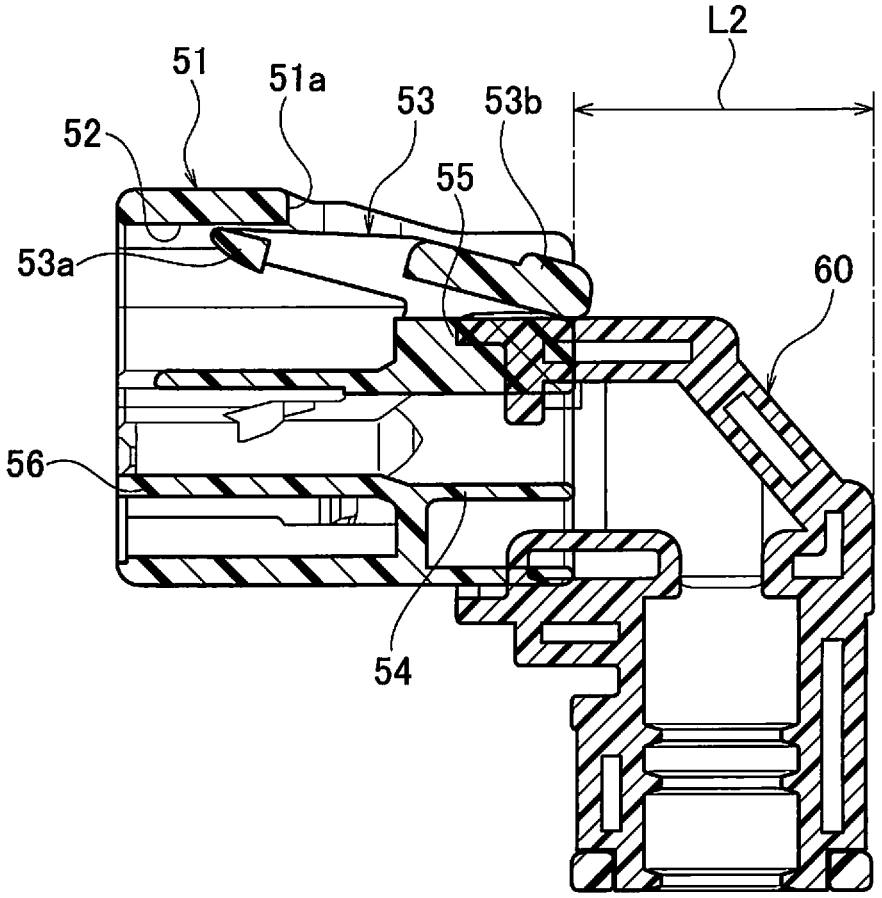
FIG. 5 is a cross-sectional view showing a state in which the wire cover is attached to the connector housing of the conventional example in a way that a portion of the wire cover is inserted into a rear-side portion of the connector housing.
Figure 6:
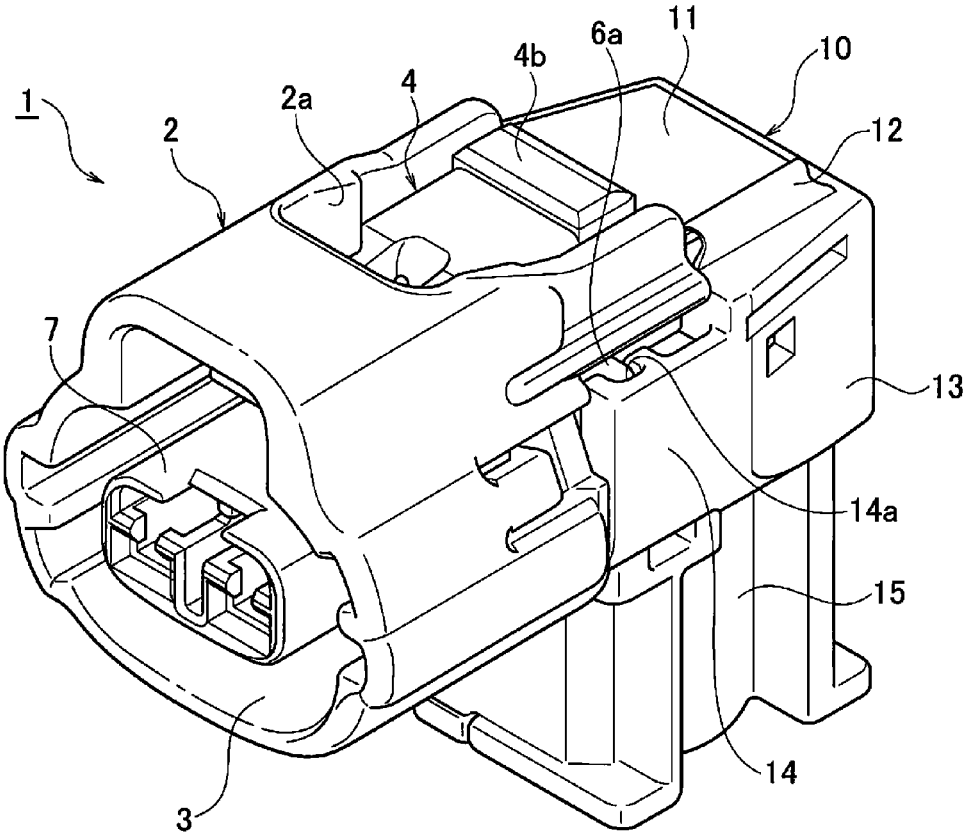
FIG. 6 shows an embodiment of the present invention, and is a perspective view of a connector.
Figure 7:
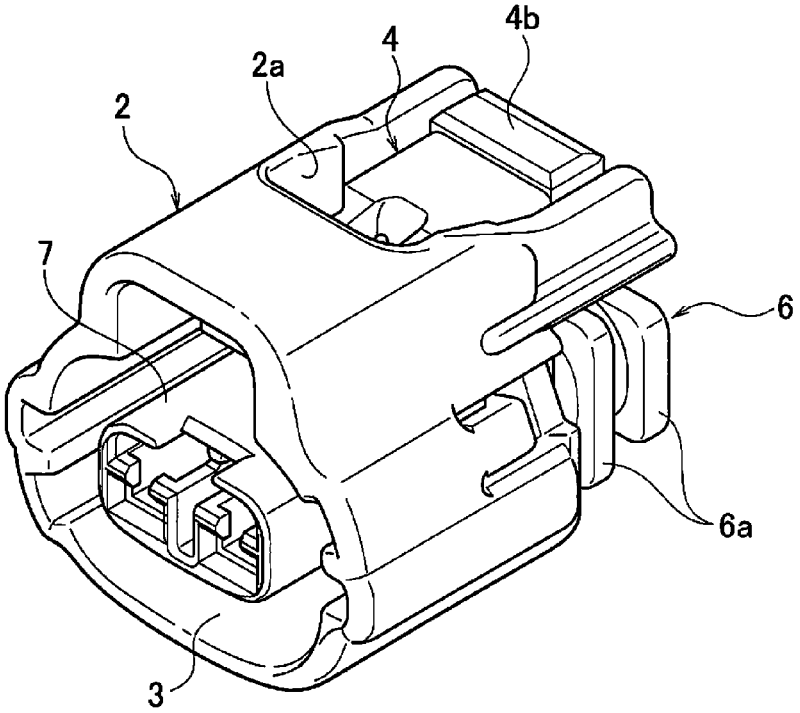
FIG. 7 shows the embodiment of the present invention, and is a perspective view of a connector housing which is viewed from the housing front.
Figure 8:
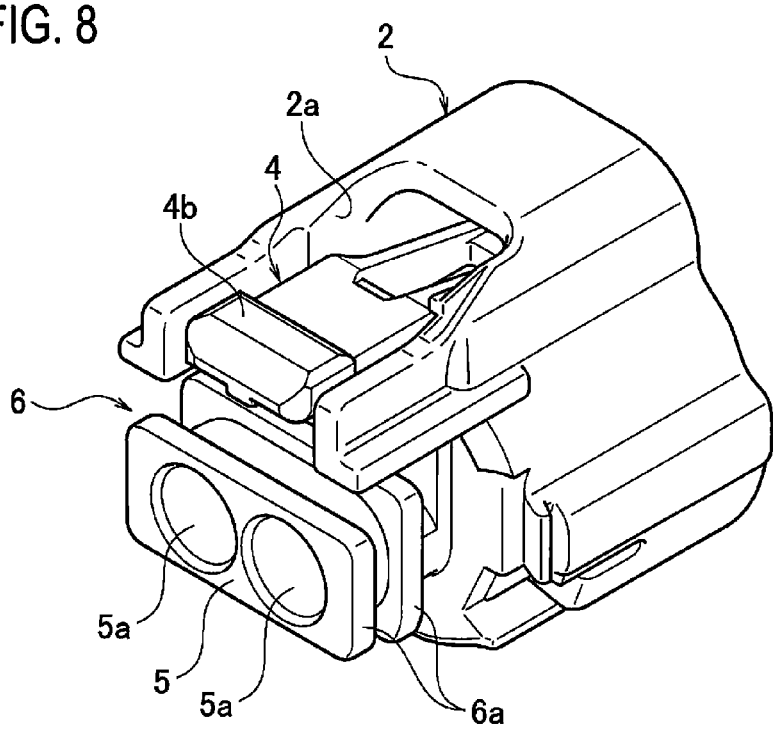
FIG. 8 shows the embodiment of the present invention, and is a perspective view of the connector housing which is viewed from the housing rear.
Figure 9:
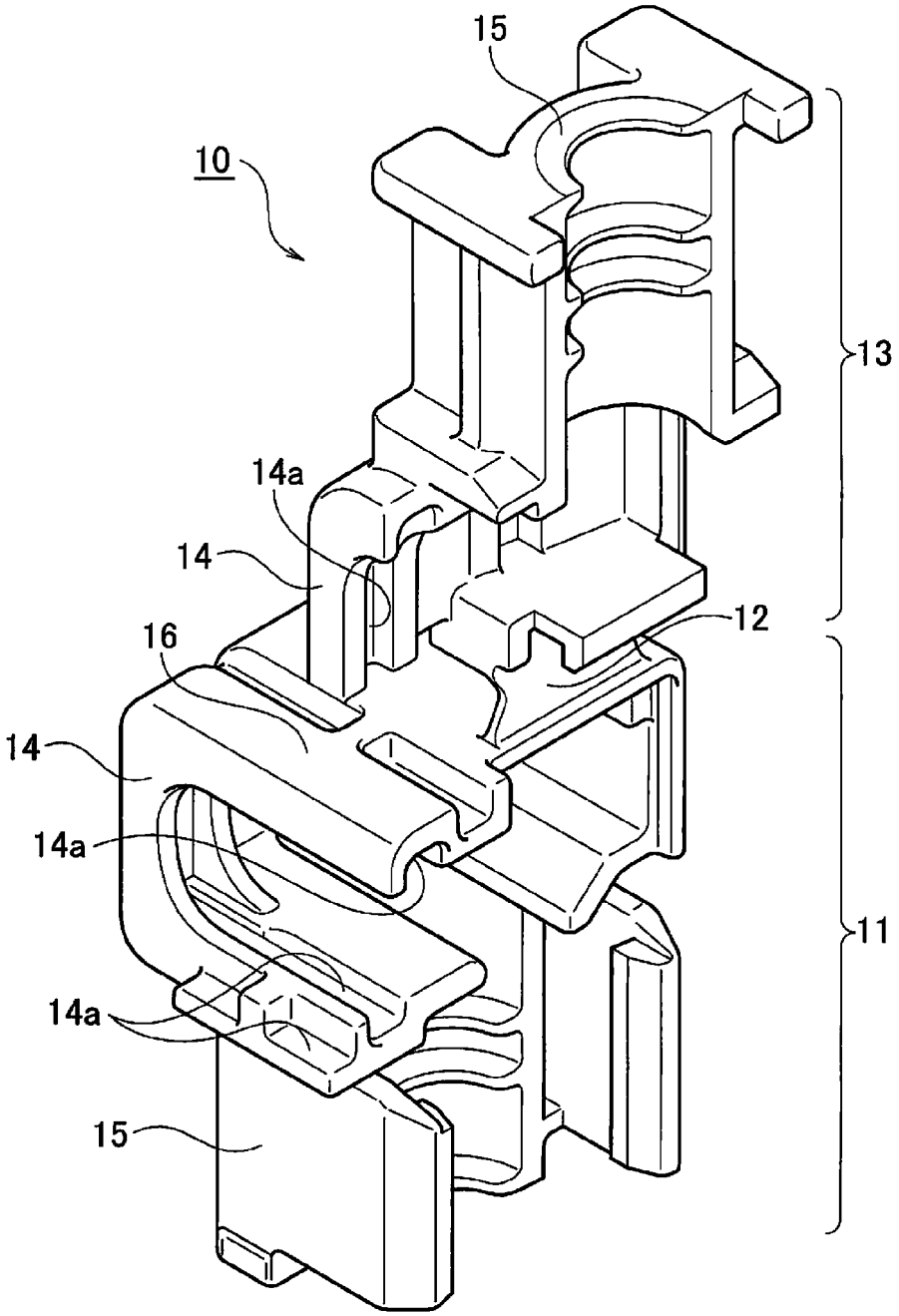
FIG. 9 shows the embodiment of the present invention, and is a perspective view of a wire cover with a lid body left open.
Figure 10A:
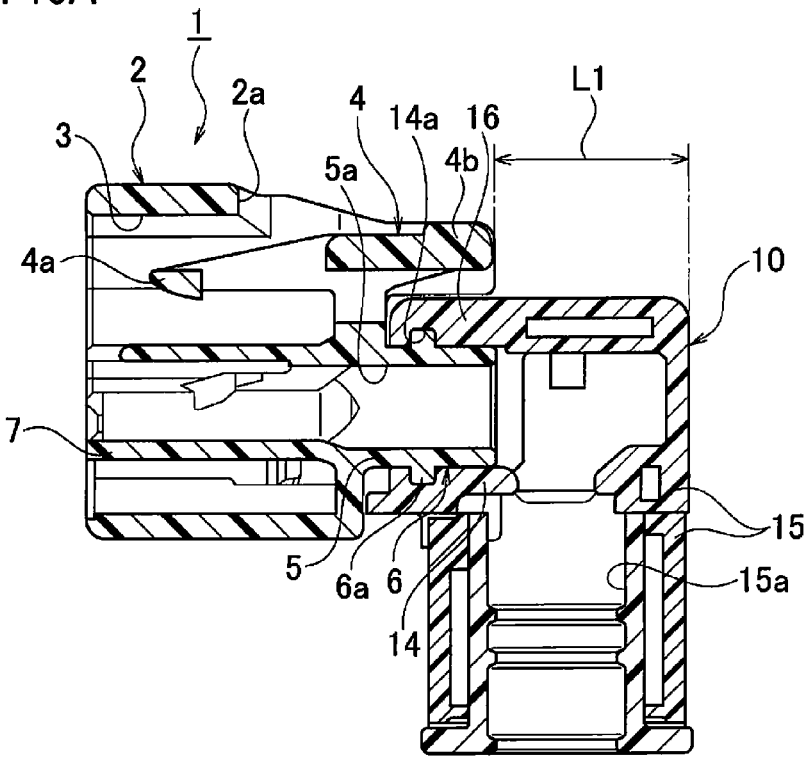
Figure 10B:
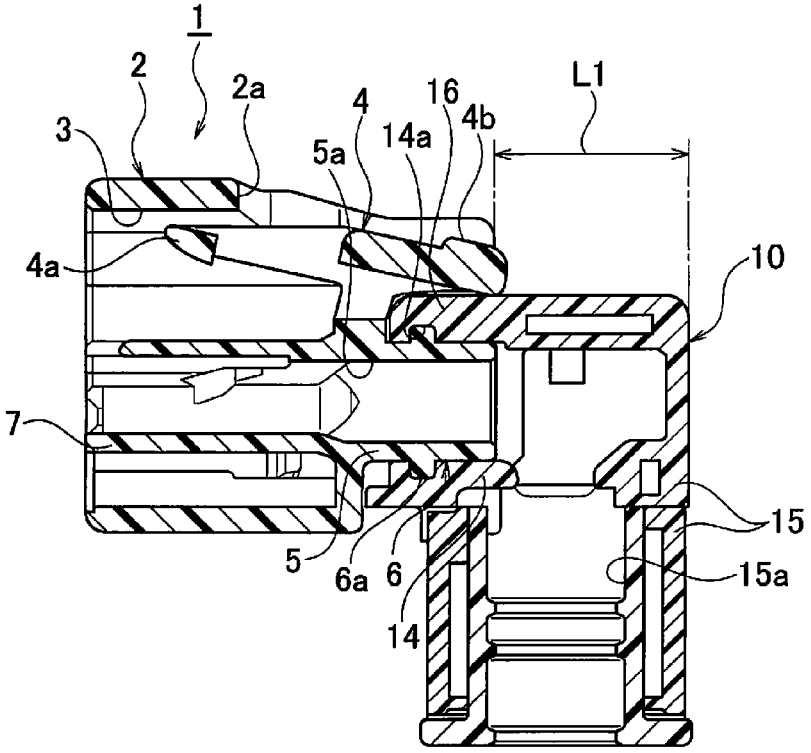

FIG. 6 to FIG. 10B show the embodiment of the present invention. As shown in FIG. 6, FIG. 10A and FIG. 10B, a connector 1 includes: a connector housing 2; and a wire cover 10 attached to the housing rear side of the connector housing 2.

As shown in FIG. 7, FIG. 8, FIG. 10A and FIG. 10B, the connector housing 2 includes: a corresponding housing mating chamber 3 open on the housing front side; a lock arm 4 configured to lock a corresponding housing (not illustrated) which is mated to the corresponding housing mating chamber 3; a wire extraction part 5 configured to guide wires (not illustrated) to be extracted to the outside; and a cover attachment part 6 provided to the peripheral side of the wire extraction part 5.

Terminal housing parts 7 are projectingly provided in the corresponding housing mating chamber 3. Two terminals (not illustrated) are housed in the terminal housing parts 7, respectively. One end of each wire (not illustrated) is connected to the corresponding one of the terminals (not illustrated).

The lock arm 4 is swingably supported by a center portion of the connector housing 2. A lock part 4*a* is provided to one end side of the lock arm 4. The lock part 4*a* is positioned in the corresponding housing mating chamber 3, and has an inclined surface (tapered surface) which faces the terminal housing parts 7. This inclined surface inclines in the insertion direction of the corresponding connector housing (not illustrated) in such a way as to become closer to the terminal housing parts 7. An arm operation part 4*b* is provided to the opposite end side of the lock arm 4. The arm operation part 4*b* is positioned on the housing rear side. An opening part 2*a* is formed in the connector housing 2 on the upper surface side of the arm operation part 4*b*. Workers can press down the arm operation part 4*b* by use of this opening part 2*a*. By pressing down the arm operation part 4*b*, the lock arm 4 can be displaced from the lock position (the position shown in FIG. 10A) to the lock release position (the position shown in FIG. 10B) by elastic deformation. When the pressing of the arm operation part 4*b* is stopped, the lock arm 4 returns from the lock release position (the position shown in FIG. 10B) to the lock position (the position shown in FIG. 10A) by elastic return deformation.

The wire extraction part 5 is provided closer to the housing rear than the terminal housing parts 7 is. The wire extraction part 5 is positioned in the release operation direction of the arm operation part 4*b*. The wire extraction part 5 includes two wire passages 5*a*. One end of each wire passage 5*a* is open in a corresponding one of the terminal housing parts (not illustrated), and the opposite end of the wire passage 5*a* is open in the housing rear. The wires (not illustrated) connected to the terminals (not illustrated) pass through the wire passages 5*a* of the wire extraction part 5, and are guided to the outside from the housing rear.

A housing rear-side portion of the wire extraction part 5 is the cover attachment part 6. The cover attachment part 6 includes almost two lock wall parts 6*a* which are provided projectingly in the circumferential direction.

As shown in FIG. 9, FIG. 10A and FIG. 10B, the wire cover 10 is formed as a unitary part including: a cover main body 11; and a lid body 13 connected to the cover main body 11 with a hinge part 12 interposed in between. The shape of the wire cover 10 can be changed from a separated state to a combined state. In the separated state, as shown in FIG. 9, the joining surfaces of the cover main body 11 and the lid body 13 are separated from each other. In the combined state, the joining surfaces of the cover main body 11 and the lid body 13 are butted up against each other.

Divided halves of a housing attachment part 14 and divided halves of a wire cover main body part 15 are provided to the cover main body 11 and the lid body 13. When combined together, the housing attachment part 14 and the wire cover main body part 15 form a continuous shape. The housing attachment part 14 includes almost two lock groove parts 14*a* extending in the circumferential direction in its inner surface. When the shape of the wire cover 10 is changed from the separated state to the combined state, the housing attachment part 14 is inserted into the rear-side portion of the connector housing 2, and is mated to the periphery of the cover attachment part 6. In other words, the lock wall parts 6*a* of the cover attachment part 6 are inserted into the lock groove parts 14*a* of the housing attachment part 14, respectively.

While in the combined state, a wire passage 15*a* is formed in the wire cover main body 15. The wires (not illustrated)

guided from the wire extraction part 5 of the connecter housing 2 are extracted to the outside through the wire passage 15*a*.

A portion of the housing attachment part 14 closer to the arm operation part 4*b* is an arm excessive displacement prevention part 16. While the wire cover 10 is attached to the connector housing 2, the arm excessive displacement prevention part 16 is positioned in the lock release direction of the arm operation part 4*b*, and restricts the excessive operation of the arm operation part 4*b*, namely the excessive displacement of the lock arm 4.

For connector mating with the foregoing configuration, first of all, the wire cover 10 is attached to the housing rear side of the connector housing 2 while the wires (not illustrated) extracted from the wire extraction part 5 are housed inside the wire cover 10. Thereafter, the corresponding connector housing (not illustrated) is inserted into the corresponding housing mating chamber 3. During the insertion, a front end portion of the corresponding connector housing comes into contact with the inclined surface of the lock part 4*a*, and the lock part 4*a* is subsequently pressed up toward a side surface of the corresponding housing mating chamber 3 in response to the insertion of the corresponding connector housing. When the corresponding connector housing is inserted up to the mating completion position, a locked part (not illustrated) of the corresponding connector housing reaches a position corresponding to the lock part 4*a*. Once the locked part reaches the position, the lock arm 4 returns to the lock position (the position shown in FIG. 10A), and the lock part 4*a* is locked to the locked part (not illustrated) of the corresponding connector housing. Thereby, the two connector housings 2 (not illustrated) are locked together in the mated state.

For the release of the connector mating, the lock arm 4 is moved to the lock release position by pressing down the arm operation part 4*b*, and the corresponding connector housing (not illustrated) is pulled out of the corresponding housing mating chamber 3.

As described above, the connector includes the connector housing 2 and the wire cover 10. The connector housing includes: the lock arm 4 configured to lock the corresponding housing (not illustrated) which is mated to the corresponding housing mating chamber 3; the arm operation part 4*b* capable of displacing the lock arm 4 to the lock release position by an operation; the wire extraction part 5 positioned in the release operation direction of the arm operation part 4*b*, and configured to guide the wires (not illustrated) to be guided to the outside; and the cover attachment part 6 provided to the peripheral side of the wire extraction part 5. The wire cover 10 includes: the housing attachment part 14 to be inserted into the peripheral side of the wire extraction part 5 of the connector housing 2, and to be mated to the cover attachment part 6; and the arm excessive displacement prevention part 16 configured to restrict the excessive displacement of the lock arm 4. Since the wire cover 10 is attached to the connector housing 2 by inserting the housing attachment part 14 of the wire cover 10 into the connector housing 2, the protrusion dimension L1 (shown in FIGS. 10A and 10B) that the wire cover 10 protrudes from the connector housing 2 becomes smaller. In addition, since the arm excessive displacement prevention part 16 is provided to the wire cover 10, the excessive displacement of the lock arm 4 can be prevented. Thus, the foregoing configuration makes it possible to make the protrusion dimension L1 of the wire cover 10 smaller, and to prevent the excessive displacement of the lock arm 4.

The arm excessive displacement prevention part 16 is formed from the portion of housing attachment part 14. For this reason, the arm excessive displacement prevention part 16 need not be provided separated from the housing attachment part 14, and accordingly the structure can be simplified.

What is claimed is:

1. A connector comprising:

a connector housing including a lock arm configured to lock a corresponding housing which is mated to a corresponding housing mating chamber, an arm operation part capable of displacing the lock arm to a lock release position by an operation, a wire extraction part positioned in a release operation direction of the arm operation part, and configured to guide wires to be guided to an outside, and a cover attachment part provided to the wire extraction part; and a wire cover including a housing attachment part to be inserted into a peripheral side of the wire extraction part of the connector housing, and to be mated to the cover attachment part, and an arm excessive displacement prevention part configured to restrict excessive displacement of the lock arm;

wherein the housing attachment part includes a lock groove part in an inner surface thereof, the cover attachment part includes a lock wall part projectingly provided in a circumferential direction thereof, and the lock wall part is inserted into the lock groove part so that the housing attachment part is mated to the cover attachment part.

2. The connector of claim 1, wherein the arm excessive displacement prevention part is formed from a portion of the housing attachment part.

* * * * *